US007770386B2

(12) United States Patent
Lowe et al.

(10) Patent No.: US 7,770,386 B2
(45) Date of Patent: Aug. 10, 2010

(54) FILTER DESULFATION SYSTEM AND METHOD

(75) Inventors: Michael D. Lowe, Metamora, IL (US); Wade J. Robel, Normale, IL (US); Maarten Verkiel, Metamora, IL (US); James J. Driscoll, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 803 days.

(21) Appl. No.: 11/022,692

(22) Filed: Dec. 28, 2004

(65) Prior Publication Data

US 2006/0137329 A1 Jun. 29, 2006

(51) Int. Cl.
*F01N 3/00* (2006.01)

(52) U.S. Cl. ..... 60/295; 60/274; 60/286; 60/287; 60/292; 60/297; 60/303

(58) Field of Classification Search ..... 60/285, 60/286, 287, 288, 295, 274, 297, 301, 303, 60/324

See application file for complete search history.

(56) References Cited

U.S. PATENT DOCUMENTS

| | | | | |
|---|---|---|---|---|
| 5,715,677 | A * | 2/1998 | Wallman et al. | 60/274 |
| 5,974,791 | A * | 11/1999 | Hirota et al. | 60/276 |
| 5,983,627 | A * | 11/1999 | Asik | 60/274 |
| 6,189,316 | B1 * | 2/2001 | Surnilla et al. | 60/274 |
| 6,293,094 | B1 * | 9/2001 | Schmidt et al. | 60/284 |
| 6,651,618 | B1 | 11/2003 | Coleman et al. | |
| 6,699,448 | B2 | 3/2004 | Wu et al. | |
| 6,708,486 | B2 * | 3/2004 | Hirota et al. | 60/297 |
| 6,779,339 | B1 * | 8/2004 | Laroo et al. | 60/297 |
| 6,813,882 | B2 * | 11/2004 | Hepburn et al. | 60/286 |
| 7,165,393 | B2 * | 1/2007 | Betta et al. | 60/286 |

* cited by examiner

*Primary Examiner*—Binh Q. Tran
(74) *Attorney, Agent, or Firm*—Finnegan, Henderson, Farabow, Garrett & Dunner

(57) ABSTRACT

A method of removing sulfur from a filter system of an engine includes continuously passing an exhaust flow through a desulfation leg of the filter system during desulfation. The method also includes sensing at least one characteristic of the exhaust flow and modifying a flow rate of the exhaust flow during desulfation in response to the sensing.

33 Claims, 3 Drawing Sheets

FILTER DESULFATION SYSTEM AND METHOD

GOVERNMENT RIGHTS

This invention was made with Government support under the terms of Contract No. DE-FC05-97OR22605 awarded by the Department of Energy. The Government may have certain rights in this invention.

TECHNICAL FIELD

The present disclosure relates generally to filter systems and, more particularly, to techniques for on-vehicle filter desulfation.

BACKGROUND

Engines, including diesel engines, gasoline engines, natural gas engines, and other engines known in the art, may exhaust a complex mixture of air pollutants. The air pollutants may be composed of gaseous and solid material, including particulate matter, nitrogen oxides ("NOx"), and sulfur compounds.

Due to heightened environmental concerns, exhaust emission standards have become increasingly stringent over the years. The amount of pollutants emitted from an engine may be regulated depending on the type, size, and/or class of the engine. One method that has been implemented by engine manufacturers to comply with the regulation of particulate matter, NOx, and sulfur compounds exhausted to the environment has been to remove these pollutants from the exhaust flow of an engine with filters. However, using these filters for extended periods of time may cause the pollutants to build up in the components of the filters, thereby causing filter functionality and engine performance to decrease. For example, some engine exhaust systems may include one or more NOx absorbers useful in removing NOx from an exhaust flow. In addition to storing NOx, the alkali metals, alkali earth metals, and/or rare earth metals of the NOx absorber catalyst may also store sulfur compounds. During this process, sulfur present in the exhaust flow is oxidized and the resulting ions are absorbed by the metals of the NOx absorber catalyst to form stable sulfates. These sulfates have a higher binding affinity for the metals of the catalyst than do nitrates and will reduce the number of sites available for NOx absorption within the NOx absorber over time, thereby reducing the effectiveness of the NOx absorber. Thus, in order to improve the performance of the NOx absorber, it may be necessary to periodically purge the sulfur compounds stored therein. The process of removing sulfur compounds from a NOx absorber will be referred to herein as "desulfation."

One desulfation method may include injecting a reductant, such as diesel fuel, into an exhaust flow at an elevated temperature. For example, U.S. Pat. No. 6,779,339 ("the '339 patent") to Laroo et al., describes a method and apparatus for desorbing sulfates from a NOx absorber in a fuel rich environment. The system of the '339 patent includes two exhaust flow legs, each including a NOx absorber and a particulate filter. Once a desired desulfation temperature is reached in the NOx absorber of the leg requiring desulfation ("the desulfation leg"), the desulfation leg is closed to exhaust flow and all of the exhaust flow is passed through the nondesulfation leg. Reductant is then sprayed into the particulate filter of the desulfation leg, and the injection is controlled to maintain a desired air-to-fuel ratio ("lambda"). If the NOx absorber catalyst's temperature decreases below optimal desulfation temperatures as sulfur is released therefrom, exhaust flow is once again allowed into the desulfation leg to initiate an exothermic reaction across the particulate filter. The heat given off is then convectively transferred to the NOx absorber to increase its temperature.

Although the filter system of the '339 patent may assist in removing sulfur from the NOx absorber, the method of the '339 patent does not continuously pass the engine exhaust through the desulfation leg during desulfation or actively control the desulfation temperature by varying the exhaust flow rate. Instead, the desulfation leg is closed to exhaust flow when the desired desulfation temperature is reached in the NOx absorber. As a result, the method of the '339 patent provides a variable desulfation temperature that may decrease below optimal desulfation temperatures during sulfur release. Moreover, the disclosed desulfation process may degrade parts of the system due to the high temperatures created and the absence of exhaust flow through the desulfation leg during the process.

The filter system of the present disclosure is directed to overcoming one or more of the problems set forth above.

SUMMARY OF THE INVENTION

In one embodiment of the present disclosure, a method of removing sulfur from a filter system of an engine includes continuously passing an exhaust flow through a desulfation leg of the filter system during desulfation.

The method also includes sensing at least one characteristic of the exhaust flow and modifying a flow rate of the exhaust flow during desulfation in response to the sensing.

In another embodiment of the present disclosure, a method of removing sulfur from a NOx absorber of an engine filter system includes heating the NOx absorber to a desired temperature and injecting a reductant into an exhaust flow upstream of the NOx absorber. The method further includes holding the desired temperature substantially constant during desulfation.

In still another embodiment of the present disclosure, A filter system having desulfation capabilities includes a first leg and a second leg. At least one of the legs includes a valving mechanism configured to direct a portion of an exhaust flow from an engine through the respective leg. The valving mechanism modifies a flow rate of the portion during desulfation, in response to a sensed temperature.

DETAILED DESCRIPTION

Figure 1:
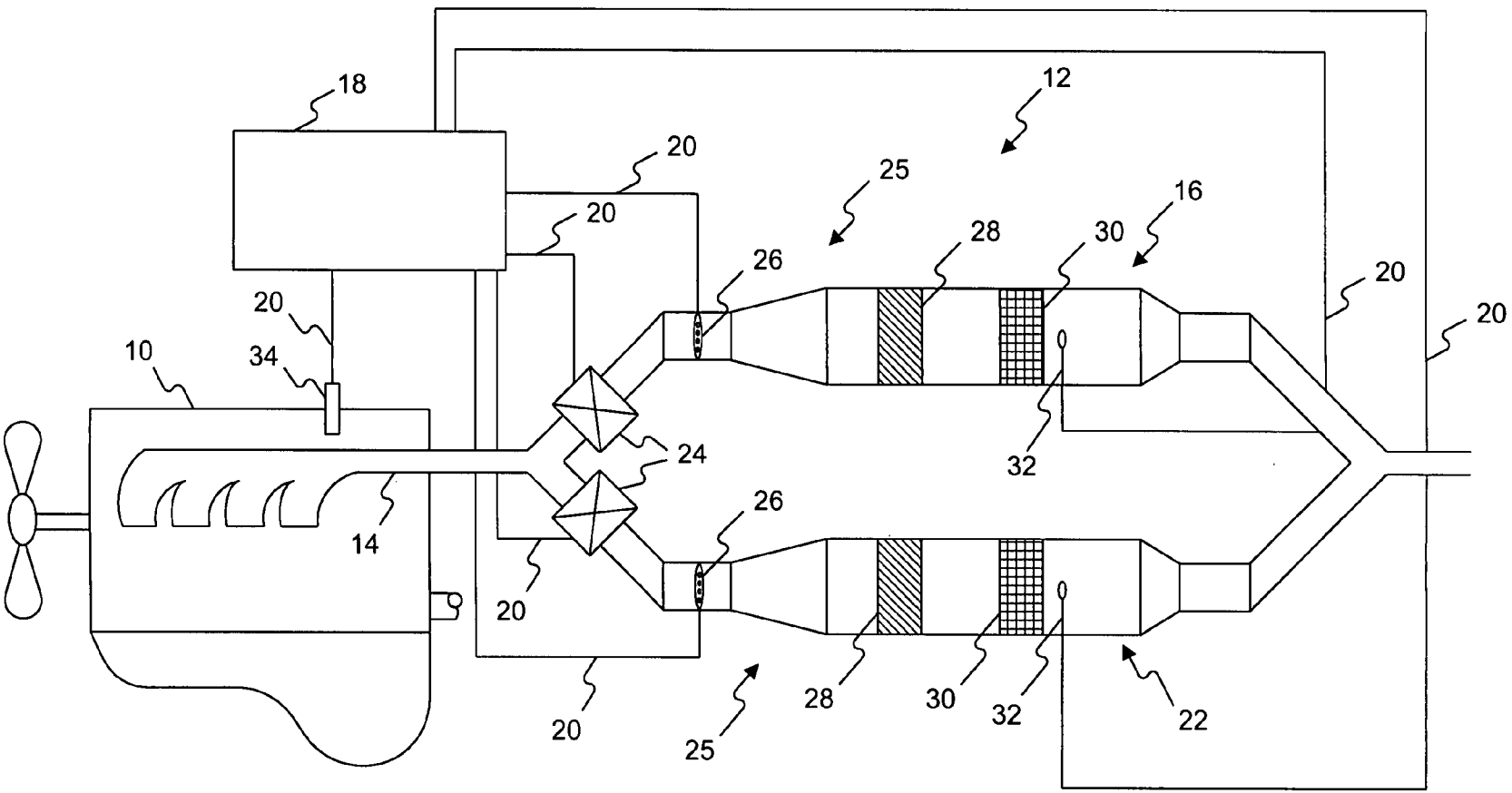
FIG. 1 is a diagrammatic illustration of an engine having a filter system according to an exemplary embodiment of the present disclosure.

FIG. 1 illustrates an internal combustion engine 10, such as a diesel engine having an exemplary embodiment of a filter system 12. Engine 10 may have an engine exhaust manifold 14 connecting an exhaust flow of the engine 10 to the filter system 12. A controller 18 may be in communication with one or more components of the filter system 12 and the engine 10 via one or more communication lines 20.

As shown in FIG. 1, the filter system 12 may include a number of legs through which an exhaust flow from the engine 10 may flow. In an exemplary embodiment of the present disclosure, the filter system 12 may include a first leg 16 and a second leg 22. Although FIG. 1 shows only two legs 16, 22, the filter system 12 may include any number of legs useful in removing pollutants from an exhaust flow. The legs 16, 22 may be any shape or size useful in removing pollutants from an exhaust flow, and may include additional flow paths (not shown) capable of controllably fluidly connecting, for example, the first and second legs 16, 22. Each of the legs 16, 22 may include a valving mechanism 24 disposed upstream of a NOx absorber 30. Each of the legs 16, 22 may also include an oxygen bleeding assembly 25 disposed between the NOx absorber 30 and valving mechanism 24. As will be discussed in greater detail below, the oxygen bleeding assembly 25 may include at least one nozzle 26 and an oxygen catalyst 28, and each of the legs 16, 22 may include at least one sensor 32. Unless otherwise noted, reference will be made to one leg of the filter system 12 for the duration of this disclosure. It is understood that each of the other legs of the system 12 include the same or similar parts and components as indicated by common reference numbers.

The NOx absorber 30 may be any type of NOx absorber known in the art. The NOx absorber 30 may contain catalyst material capable of collecting oxides of nitrogen on their outer surfaces. Such materials may include, for example, aluminum, platinum, radium, barium, cerium, or other alkali metals, alkali earth metals, or rare earth metals. The catalyst materials may be situated within the NOx absorber 30 so as to maximize the surface area available for NOx absorption. Such configurations may include, for example, a honeycomb, mesh, or any other configuration known in the art. Each NOx absorber 30 may be disposed within the respective leg 16, 22 substantially perpendicular to the flow of exhaust through the leg 16, 22.

The oxygen bleeding assembly 25 may include an oxidation catalyst 28 and at least one nozzle 26. The oxidation catalyst 28 may contain catalyst materials such as, for example, platinum or other precious metals useful in reacting hydrocarbons with oxygen. Such a reaction will occur when oxygen is combined with a reductant in the presence of the above-mentioned catalyst materials at temperatures greater than approximately 250° C. The reductant may be raw diesel fuel, reformed diesel fuel, a hydrocarbon gas, reformate, or any other reduction agent known in the art. It is understood that some types of reductants may also consist of a carrier gas known in the art. This carrier gas may be required if a non-gaseous reductant such as, for example, liquid diesel fuel is used as a reductant. In such an embodiment, the carrier gas may mix with the diesel fuel and carry the diesel through the catalyst.

It is understood that the oxidation catalyst 28 may be, for example, a catalized diesel particulate matter filter or any other device having oxidation functionality. For example, in an embodiment the oxidation catalyst 28 may include, a ceramic substrate, a metallic mesh, foam, or any other porous material known in the art. These materials may form, for example, a honeycomb structure within the oxidation catalyst 28 to facilitate the removal of particulates. The particulates may be, for example, soot.

The nozzles 26 may be positioned upstream of the oxidation catalyst 28, as illustrated in FIG. 1. The term "nozzle," as used herein, is defined as any dispersion mechanism or other mechanism capable of dispensing a flow of gas or fluid supplied to it. The nozzles 26 may be, for example, fuel injectors, port flow injectors, or any type of structure capable of distributing reductant across a cross-section of the legs 16, 22 in a controlled manner. The type of nozzles 26 employed may depend on the type of reductant used, and the nozzles 26 may be supplied with reductants from a number of different sources. For example, the filter system 12 may further include a reformer (not shown) capable of partially oxidizing the reductant supplied to the nozzles 26 or, alternatively, the nozzles 26 may be supplied with diesel fuel or other reductants directly from a reductant supply pump (not shown) or other pressurizing device.

Figure 1A:
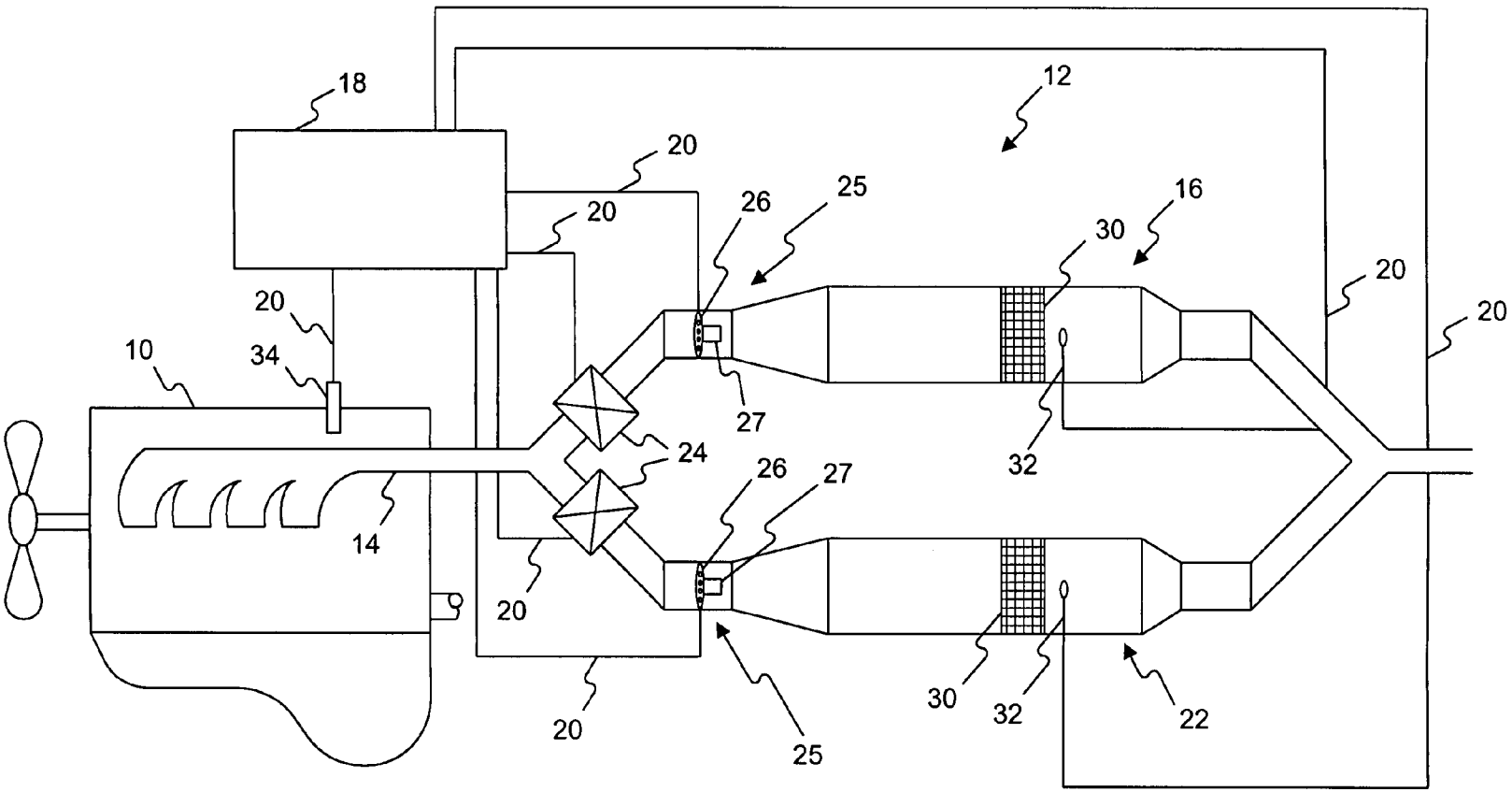
FIG. 1*a* is another diagrammatic illustration of the engine and filter system of FIG. 1.

As shown in FIG. 1*a*, in an embodiment of the present disclosure, the bleeding assembly 25 may include a conventional burner known in the art. In such an embodiment, the nozzles 26 may be combined with an ignition source 27 to facilitate oxidation of the injected reductant upstream of the NOx absorber 30. In such embodiments, the oxidation catalyst 28 may be omitted.

As shown in FIG. 1, the valving mechanisms 24 may be positioned to control the flow of exhaust through each leg 16, 22 of the filter system 12. The valving mechanisms 24 may include, for example, a flow control valve capable of allowing any range of flow to pass through the respective leg 16, 22. For example, each flow control valve may be controllably positioned to allow any range of flow through the legs 16, 22 from completely restricting the flow to completely unrestricting the flow. The valving mechanisms 24 may further include one or more motors (not shown), solenoids, or any other electric, pneumatic, hydraulic, or other devices known in the art to actuate elements of the valving mechanisms 24. These devices may receive, and be responsive to, commands from the controller 18 sent across the communication lines 20.

The controller 18 may be, for example, an electronic control module ("ECM"), a central processing unit, a laptop computer, or any other control device known in the art. The controller 18 may receive input from a variety of sources including, for example, filter system sensors 32 (described in greater detail below) and one or more engine sensors 34. Engine sensors 34 may include, but are not limited to, speed, load, temperature, run time, and position sensors. The controller 18 may use these inputs to form a control signal based on a preset algorithm. The control signal may be transmitted from the controller 18 to each actuation device of the valving mechanisms 24 across the communication lines 20. Thus, the flow through each of the legs 16, 22 may be independently controlled. The control signal may also be transmitted to each of the nozzles 26 to control the flow rate, volume, and/or duration of injection.

Each leg 16, 22 of the filter system 12 may further include at least one sensor 32. This sensor 32 may be, for example, a NOx sensor, an oxygen sensor, a temperature sensor, and/or other sensor capable of sensing properties of a gaseous flow. The at least one sensor 32 may have multiple capabilities. For example, in addition to detecting the presence and quantity of NOx in a flow, a NOx sensor 32 may also be capable of measuring lambda, temperature, flow rate, and/or other variables associated with the flow. Each sensor 32 may be in communication with the controller 18 via the communication lines 20. The sensor 32 may be located anywhere within or relative to the respective legs 16, 22 depending on the sensor's size, shape, type, and function. For example, as FIG. 1 illustrates, a sensor 32 may be located downstream of the NOx absorber 30. Alternatively, more than one sensor 32 may be used in each leg 16, 22. In such an embodiment, at least one of the sensors 32 may be positioned downstream of the NOx absorber and at least one of the other sensors 32 may be located, for example, between the oxygen bleeding assembly 25 and the NOx absorber 30.

INDUSTRIAL APPLICABILITY

The disclosed filter system 12 may be used with any device known in the art where the removal of NOx from an exhaust flow is desired. Such devices may include, for example, a diesel, gasoline, turbine, lean-burn, or other combustion engine or furnace known in the art. Thus, the disclosed filter system 12 may be used, for example, in conjunction with any work machine, on-road vehicle, or off-road vehicle known in the art. The operation of the filter system 12 will now be explained in detail.

Under normal engine operating conditions, exhaust from the engine 10 exits the engine exhaust manifold 14 and a portion of the flow enters each leg 16, 22 of the filter system 12. The portion passes through each component of the respective leg 16, 22 before exiting the leg, and the flow control valves 24 in each leg 16, 22 are in a fully open position. The NOx absorbers 30 may remove at least some of the NOx from the exhaust flow passing through them. In addition, a sensor 32 may sense at least one characteristic of the flow exiting the filter system 12. The flow characteristic may be, for example, parts per million of NOx released by the respective leg 16, 22 of the filter system 12 after filtration by the NOx absorbers 30, temperature, lambda, flow rate, pressure differential over one or more components of the leg 16, 22, or a combination of these characteristics. The sensor 32 may send a signal corresponding to these sensed characteristics to the controller 18, and the controller 18 may evaluate the information in the signal. The controller 18 may also receive and evaluate signals sent from one or more engine sensors 34. These engine sensor signals may correspond to sensed engine parameters such as, for example, engine load, temperature, run time, and/or crank shaft position. Upon exiting the respective legs 16, 22, the portions of the flow may come together to form a single filtered exhaust flow.

As the engine 10 operates, NOx in the exhaust gas of the engine 10 may become chemically bound to the catalyst materials of the NOx absorber 30. However, due to the size of the NOx absorber 30, the number of NOx storage sites on these catalysts may be limited, and sulfur contained in both the lubrication oil and fuel of the engine 10 may also become bound thereto. As more of these sites become occupied by compounds such as, for example, $SO_2$, $SO_3$, and/or $H_2S$, the NOx absorber's ability to store NOx may decrease depending on, for example, the type of engine 10, the run conditions, and the type of fuel used. Thus, after a period of engine operation (e.g. approximately 50 to 100 hours), the NOx absorber 30 may require desulfation.

As will be discussed in greater detail below, to remove sulfur compounds from the catalyst material of the NOx absorber 30 through conventional desulfation processes, two conditions must be met: 1) the NOx absorber 30 must be exposed to temperatures within the range of approximately 500° C. to approximately 800° C., and 2) the normalized ratio of air to fuel (lambda) must be less than 1. For example, through testing it has been determined that a catalyst lambda (measured downstream of the injectors 26) of approximately 0.9 and a desulfation temperature of approximately 750° C. may effectively desorb the NOx absorber 30. With respect to the first condition of increasing the NOx absorber temperature, this is achieved by creating an exothermic reaction across the oxidation catalyst 28 located upstream of the NOx absorber 30. Such an exothermic reaction requires two conditions: 1) heating the oxidation catalyst 28 to an activation temperature of approximately 250° C., and 2) exposing the metals disposed therein to reductant in the presence of oxygen. With respect to the second condition of maintaining a lambda of less than 1 (rich exhaust environment), this may be achieved by simply injecting reductant upstream of the NOx absorber 30 until the desired ratio of air to fuel is reached. As the injection of reductant transitions the exhaust flow from lean to rich, both a desired lambda and a desired desulfation temperature may be held substantially constant by varying at least the exhaust flow rate in conjunction with the reductant flow rate during desulfation. Accordingly, the temperature increase attributed to injecting reductant (thereby achieving a catalyst lambda of less than 1) may be offset by decreasing the exhaust flow rate through the desulfation leg during desulfation.

During operation, the controller 18 may use information sent from the sensor 32 and/or the engine sensor 34 in conjunction with an algorithm or other preset criteria to determine whether the NOx absorber 30 has become saturated with sulfur compounds and is in need of desulfation. For example, the algorithm may be capable of determining the amount of NOx being produced by the engine based on the run time of the engine 10, engine load, engine speed, engine temperature, and/or any other engine control parameter. By measuring the parts per million of NOx released by the respective NOx absorber 30 in conjunction with the known regeneration schedule for the NOx absorber 30, the controller 18 may determine the amount of sulfur stored on the catalyst material.

Once the controller 18 determines it is necessary to desorb the NOx absorber 30, the controller 18 will control the heating of the oxidation catalyst 28 to its activation temperature. This "activation temperature" is defined herein as the temperature at which oxygen will begin to exothermically react with a reductant in the presence of the materials of the oxidation catalyst 28. This temperature is typically in the range of approximately 200° C. to approximately 250° C., and may be much lower than the combustion temperature of most reductants. Once the oxidation catalyst 28 has reached its activation temperature, oxygen will begin to exothermically react with the reductant present in the exhaust flow on the surface of the materials of the oxidation catalyst 28. This exothermic reaction can be controlled to produce enough energy to heat the NOx absorber 30 to the desired desulfation temperature. As used herein, the term "desulfation temperature" is defined as the temperature of the NOx absorber 30 during desulfation. The NOx absorber 30 will be heated through convection as the exhaust flow travels from the oxidation catalyst 28 to the NOx absorber 30 and the desulfation temperature may be determined by, for example, sensing the temperature of an exhaust flow downstream of the NOx absorber 30 during desulfation. As mentioned above, this desired desulfation temperature is in the range of approximately 500° C. to approximately 800° C.

The controller 18 may rely on the sensor 32 to detect the approximate temperature of the oxidation catalyst 28 based on the sensed temperature of the exhaust flow downstream of the NOx absorber 30. Alternatively, the filter system 12 may include an additional sensor in close proximity to the oxidation catalyst 28 configured to sense its temperature.

To heat the oxidation catalyst 28 to its activation temperature in situations where the temperature of the oxidation catalyst 28 is below the desired activation temperature, the controller 18 may control the engine 10 to increase the temperature of the exhaust gas produced. The temperature of the oxidation catalyst 28 will, thus, be increased to its activation temperature through simple convection as the temperature of the exhaust gas is increased. Exemplary engine strategies that may be employed to increase the temperature of the exhaust gas include, for example, engine throttling, increasing engine load, wastegateing, and intake valve actuation. Each of these processes may also enable the controller 18 to actively control the engine-out lambda by making engine combustion more or less efficient. As used herein, the term "engine-out lambda" is defined as the normalized air to fuel ratio of exhaust gas as it exits the exhaust manifold 14 of the engine 10. Engine-out lambda may be different from catalyst lambda. Moreover, it is understood that catalyst lambda does not change as a result of reductant contained within the exhaust flow being burned off and that catalyst lambda will be lean (greater than 1) during this prewarming step.

In situations where the engine 10 has been operating under heavy loads for long periods of time, the temperature of the oxidation catalyst 28 may already be equal to or greater than the desired activation temperature. In such situations, the engine strategies mentioned above may not be required. In embodiments of the present disclosure where a burner is used in place of an oxidation catalyst 28, the prewarming step may be omitted.

Once the oxidation catalyst 28 has reached the desired activation temperature, the controller 18 may control elements of the filter system 12 to heat the NOx absorber 30 to the desired desulfation temperature mentioned above. To reduce the total time required for desorbing a leg 16, 22 of the filter system 12, it may be desirable to heat the NOx absorber 30 as rapidly and as evenly as possible. Having a lean exhaust flow (lambda greater than 1) may assist in this rapid and even heating. It is understood that the NOx absorber 30 may be heated to the desulfation temperature through convection and radiation. For example, the controller 18 may control the nozzles 26 to inject reductant upstream of the oxidation catalyst 28 at a desired reductant flow rate and for a desired length of time. The controller 18 may also control a flow rate of the exhaust flow through the desulfation leg. As heat is given off by the exothermic reaction at the oxidation catalyst, the exhaust flow may convectively transfer at least some of this heat to the NOx absorber 30.

The desired flow rate of reductant for heating the NOx absorber 30 may be controlled by one or more preset feed-forward control algorithms in the controller 18. The controller 18 may input data sensed by, for example, the engine sensor 34 into the algorithms. Such data may include, but is not limited to, engine speed, engine load, engine run time, and/or engine temperature information. The controller 18 may then calculate the flow rate needed to reach a desired desulfation temperature in the shortest amount of time. This calculation may depend on the type and size of engine 10 and the characteristics of the oxidation catalyst 28 and NOx absorber 30. Alternatively, feedback from the sensor 32 downstream of the NOx absorber 30 may be used as an algorithm input to control the flow rate of reductant. For example, the sensor 32 may measure exhaust flow temperature, exhaust flow rate, and/or any other exhaust flow characteristic known in the art. These characteristics may correspond to, for example, the temperature of the NOx absorber 30. Similarly, the duration of injection may also be controlled by either the feed-forward control algorithms or through feedback from the sensor 32.

The desired flow rate of exhaust through the desulfation leg for heating the NOx absorber 30 may be controlled by manipulating the valving mechanism 24 in the respective leg. In general, the valving mechanism 24 will remain in a completely open position while the NOx absorber 30 is heated to the desired desulfation temperature. The controller 18 may maximize the exhaust flow rate through the desulfation leg so as to increase the temperature of the NOx absorber 30 to the desulfation temperature as quickly as possible.

When heating the NOx absorber 30 to the desired desulfation temperature, however, filter system conditions may also be controlled such that substantially all of the injected reductant may be oxidized upstream of the NOx absorber 30. For example, the flow rate of exhaust through the desulfation leg may be limited in order to ensure that the reductant injected is completely oxidized oxidation catalyst 28. The controller 18 may limit the exhaust flow rate by at least partially closing the valving mechanism 24 of the desulfation leg. Limiting the exhaust flow rate may increase the residence time of the exhaust flow in the oxidation catalyst 28, thereby giving the injected reductant more time to react there and ensuring that none of the hydrocarbons contained in the reductant may reach the NOx absorber 30 in a lean operating condition. This complete oxidation at the oxidation catalyst 28 may assist in eliminating high localized temperatures on the catalyst materials of the NOx absorber 30 caused by reductant particles reacting with oxygen thereon, and may reduce the amount of catalyst material degradation over time. As a result of the complete oxidation, the NOx absorber 30 may be at substantially the same temperature as the oxidation catalyst 28. It is understood that in some situations, a small amount of reductant may pass to the NOx absorber 30 and react thereon. In such situations, the NOx absorber 30 may be at a slightly higher temperature than the oxidation catalyst 28. For example, in such situations, the NOx absorber 30 may be approximately 50° C. hotter than the oxidation catalyst 28 due to the exothermic reaction of the reductant.

Once the NOx absorber 30 has reached the desired desulfation temperature, the controller 18 may increase the flow rate of reductant injected by the injector 24 to produce a rich flow of exhaust gas through the desulfation leg and obtain a catalyst lambda of approximately 0.9. When the desired desulfation temperature and catalyst lambda have been achieved, desulfation may commence at the NOx absorber 30.

During desulfation, an exothermic oxidation reaction will occur at the oxidation catalyst 28. The partial oxidation reaction will produce carbon monoxide and hydrogen once the flow through the desulfation leg is made rich. The carbon monoxide and hydrogen produced may assist in removing, for example, sulfur compounds from NOx absorber catalyst materials at desulfation temperatures.

The sensor 32 downstream of the NOx absorber 30 may measure, for example, the amount of sulfur or sulfur compounds being released, catalyst lambda, and the temperature of the exhaust flow, and may send signals containing such information to the controller 18. The controller 18 may use the sulfur release information to determine the required duration of the desulfation process. Alternatively, the controller 18 may calculate the required duration based on one or more of the preset feed-forward control algorithms mentioned above. In addition, the controller 18 may use the lambda and temperature information to modify, for example, the engine-out lambda, the exhaust flow rate and/or the reductant flow rate during desulfation to maintain a substantially constant catalyst lambda and desulfation temperature.

The temperature increase associated with achieving the desired desulfation lambda of 0.9 may severely damage components of the filter system 12 as the exhaust flow is controlled from lean to rich. For example, theoretical calculations have shown that reducing catalyst lambda from 1.5 to 0.9 by injecting reductant into an exhaust flow at oxidation catalyst activation temperatures may result in a temperature increase of approximately 800° C. Thus, as the partial oxidation reaction takes place at the oxidation catalyst 28, the heat produced must be offset by cooling the desulfation leg in order to hold the desulfation temperature substantially constant during desulfation. To accomplish this, the controller 18 may control, for example, the engine-out lambda, the flow rate of reductant injected, and/or the exhaust flow rate through the desulfation leg to hold the catalyst lambda constant at approximately 0.9 and the NOx absorber temperature constant at approximately 750° C. These variables may be controlled across any range of engine operation to hold catalyst lambda and NOx absorber temperature constant during desulfation. It is understood that at least a portion of the exhaust flow of the engine 10 will continuously flow through the desulfation leg throughout desulfation. The controller 18 will control the valving mechanism 24 of the desulfation leg to remain partially open to facilitate this continuous flow.

The engine-out lambda may be actively controlled through a number of the engine strategies discussed above. Each of these strategies may be useful in reducing the concentration of oxygen present in the exhaust flow, thereby reducing the engine-out lambda. In doing so, however, these strategies may degrade the efficiency of the engine 10. Thus, while a typical engine-out lambda may be approximately 2.0, it may not be possible to obtain the desired desulfation lambda of 0.9 purely through engine control strategies without detrimentally effecting engine performance.

Instead, in conjunction with the aforementioned engine strategies, the flow rate of reductant injected may be increased and the exhaust flow rate in the desulfation leg may be correspondingly decreased to obtain the desired desulfation lambda. It is understood that as the exhaust flow rate in the desulfation leg is decreased, the NOx absorber temperature will decrease due to convection and radiation off the exhaust system, and the catalyst lambda will decrease. It is also understood that as the reductant flow rate is increased, the catalyst lambda will decrease. However, in a rich environment the NOx absorber temperature may depend on the exhaust flow rate in the desulfation leg, and may increase or decrease depending on the previous catalyst lambda. For example, if the exhaust flow rate in the desulfation leg is increased, NOx absorber temperature may also increase and, to keep catalyst lambda constant, the fuel flow rate may be increased accordingly. Thus, by increasing or decreasing the exhaust flow rate in the desulfation leg, and accordingly increasing or decreasing the fuel flow rate, the controller 18 can hold the catalyst lambda constant at a desired desulfation level while controlling the NOx absorber temperature.

In addition to the methods described above, it is understood that the desulfation temperature may also be controlled by decreasing the catalyst lambda to less than the 0.9 value described above. In an exemplary embodiment of the present disclosure, the catalyst lambda may be reduced to 0.5 by increasing the flow of reductant through the desulfation leg. In such an embodiment, the reductant may decrease the desulfation temperature through an endothermic steam reforming reaction known in the art. In such a reaction, the reductant may combine with $H_2O$ to form, for example, CO and $H_2$.

Once desulfation has been completed, the controller 18 will control the nozzles 26 to stop injecting reductant and will allow the NOx absorber 30 to cool. Since the desulfation process occurs in a rich environment, reductant particles will remain on the catalyst materials of the NOx absorber 30 after desulfation is complete. Thus, to prevent harm to the NOx absorber 30, flow through the desulfation leg will be minimized during this cooling step. For example, immediately following desulfation, the valving mechanism 24 may be controlled to slowly feed in exhaust from the engine 10. Oxygen will, thus, slowly contact the NOx absorber 30 of the desulfation leg and begin to burn the reductant particles present therein. The controller 18 will balance the heat created by the exothermic burning of the reductant particles and the cooling of the NOx absorber 30 through convection and radiation.

Alternatively, the controller 18 may control the valving mechanism 24 to remain closed for approximately 2 minutes, during which time all of the exhaust flow may travel through the nondesulfation leg and the NOx absorber 30 may be allowed to cool. Exhaust flow through the desulfation leg may then be ramped up in a constant or stepwise manner. Once the desulfation leg is cooled and fully opened to exhaust flow, the desulfation process may begin in another leg 16, 22 of the filter system 12.

Figure 2:
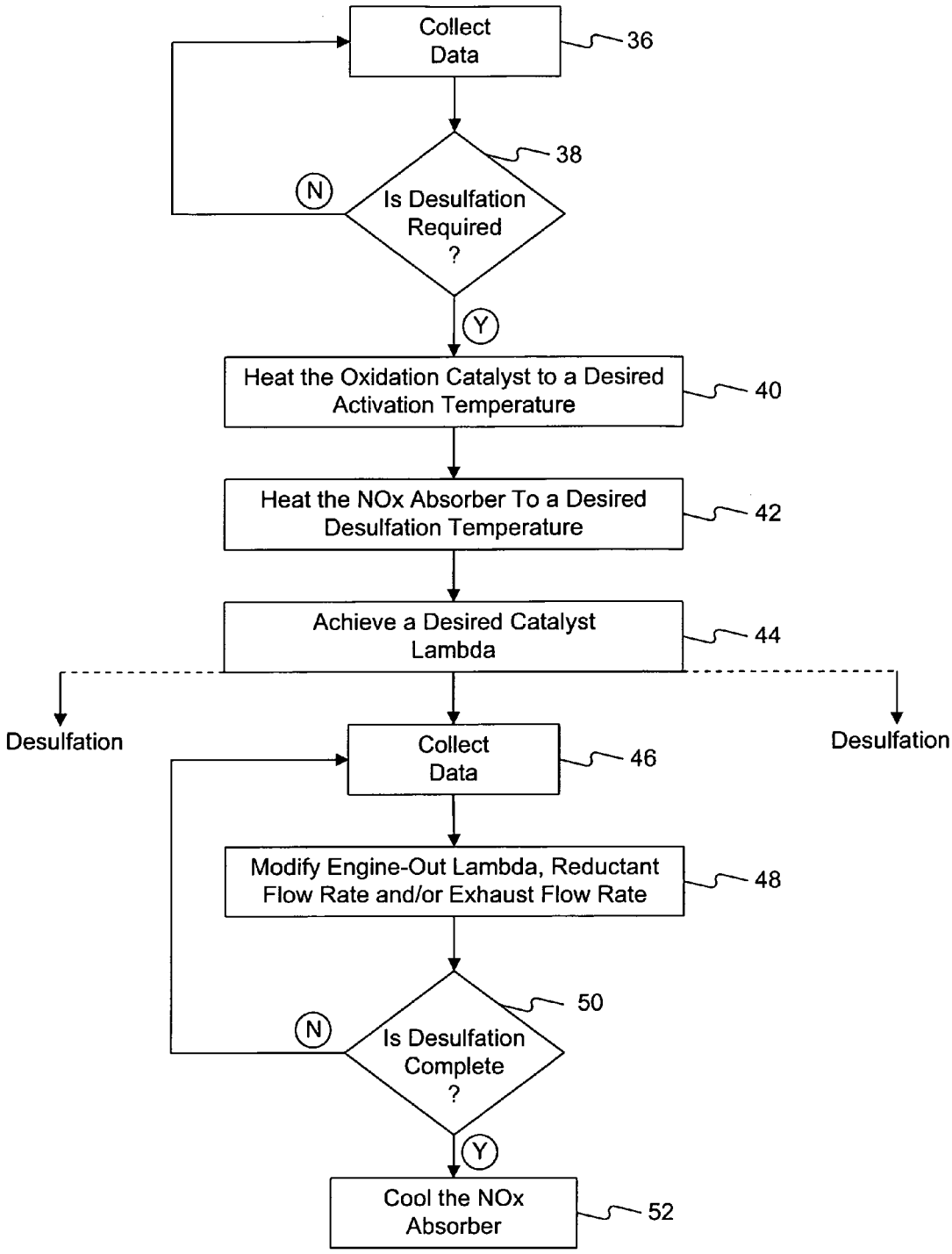
FIG. 2 is a flowchart of an exemplary method of desulfation.

As explained above, and as shown in FIG. 2, an embodiment of the disclosed method may include collecting data (Step 36) from the filter system 12. The data may be collected using the engine sensor 34 and/or sensor 32. The data may be sent to the controller 18 and input into at least one preset algorithm to determine whether desulfation is required (Step 38). If desulfation is not required (Step 38: No), data collection may continue (Step 36). If Desulfation is required (Step 38: Yes), the controller 18 may use a number of engine strategies to heat the oxidation catalyst 28 to a desired activation temperature (Step 40). Once the activation temperature has been reached, the controller 18 may control elements of the filter system 12 to heat the NOx absorber to a desired desulfation temperature (Step 42). As described above, this heating may be the result of an exothermic oxidation reaction at the oxidation catalyst 28. The nozzles 26 and/or the valving mechanisms 24 in the desulfation leg may be controlled to facilitate this reaction.

Once the desulfation temperature has been achieved at the NOx absorber 30, the controller may control the injection of reductant to achieve a desired desulfation lambda (Step 44). This lambda may be indicative of a rich flow environment and may be approximately 0.9. At these conditions, desulfation may begin in the desulfation leg.

The sensors 32, 34 may continue to collect data (Step 46) and may send the data to the controller 18 during desulfation. The controller 18 may input the data into the algorithms mentioned above to determine, for example, whether to modify any of the filter system's parameters in order to hold catalyst lambda and desulfation temperature constant during desulfation. To hold these variables constant, the controller 18 may control the modification of engine-out lambda, reductant flow rate, and/or exhaust flow rate during desulfation (Step 48). The controller 18 may also determine whether desulfation is complete (Step 50) using this data. If desulfation is not complete (Step 50: No), data collection may continue (Step 46). If desulfation is complete, the controller 18 may control the cooling of the NOx absorber 30 (Step 52).

Other embodiments of the disclosure will be apparent to those skilled in the art from consideration of the specification and practice of the invention disclosed herein. For example, the filter system 12 may further include a clean-up catalyst configured to oxidize the sulfur compounds released from the NOx absorber 30. The clean-up catalyst may be disposed downstream of the legs 16, 22 and may be configured to receive a supply of oxygen from at least one of the legs 16, 22 to assist in oxidizing the sulfur compounds.

It is intended that the specification and examples be considered as exemplary only, with the true scope of the invention being indicated by the following claims.

What is claimed is:

1. A method of removing sulfur from a filter system of an engine, comprising:

continuously passing an exhaust flow through a desulfation leg of the filter system during desulfation;

sensing at least one characteristic of the exhaust flow;

injecting a flow of reductant into the exhaust flow; and modifying a flow rate of the reductant and a flow rate of the exhaust flow during desulfation in response to the sensing such that a desired desulfation temperature is held substantially constant.

2. The method of claim 1, wherein the desired desulfation temperature is in the range of approximately 500° C. to approximately 800° C.

3. The method of claim 1, further including maintaining a desired catalyst lambda during desulfation.

4. The method of claim 3, wherein the desired catalyst lambda is approximately 0.9.

5. The method of claim 1, wherein the at least one characteristic of the exhaust flow is one of exhaust flow temperature, catalyst lambda, or exhaust flow rate.

6. The method of claim 1, further including maintaining a desired catalyst temperature prior to desulfation.

7. A method of removing sulfur from a NOx absorber of an engine filter system, comprising:

heating the NOx absorber to a desired temperature;

injecting a reductant into an exhaust flow upstream of the NOx absorber;

holding the desired temperature substantially constant during desulfation; and modifying a flow rate of the reductant during desulfation to assist in holding the desired temperature substantially constant.

8. The method of claim 7, further including modifying a flow rate of the exhaust flow during desulfation to assist in holding the desired temperature substantially constant.

9. The method of claim 8, further including modifying the flow rate of the exhaust flow during desulfation in response to a sensed exhaust flow temperature.

10. The method of claim 9, wherein the sensed exhaust flow temperature corresponds to the desired temperature.

11. The method of claim 7, further including holding a catalyst lambda of the exhaust flow substantially constant during desulfation.

12. The method of claim 11, further including modifying at least one of a flow rate of the exhaust flow and the flow rate of the reductant, during desulfation, to assist in holding the catalyst lambda substantially constant.

13. The method of claim 12, further including modifying at least one of the flow rate of the exhaust flow and the flow rate of the reductant in response to a sensed characteristic of the exhaust flow.

14. The method of claim 7, wherein the desired temperature is in the range of approximately 500° C. to approximately 800° C.

15. The method of claim 7, further including heating an oxidation catalyst to a desired temperature prior to desulfation.

16. A filter system having desulfation capabilities, comprising:

a first leg; and a second leg, at least one of the legs including a valving mechanism configured to direct a portion of an exhaust flow from an engine through the respective leg and a nozzle configured to inject reductant into the exhaust flow, the valving mechanism modifying a flow rate of the portion and the nozzle modifying a reductant flow rate, during desulfation, in response to a sensed temperature, such that a desired desulfation temperature is held substantially constant.

17. The system of claim 16, further including a controller in communication with the valving mechanism of each leg and configured to control the valving mechanisms.

18. The system of claim 16, wherein each of the legs further includes an oxygen bleeding assembly upstream of a NOx absorber.

19. The system of claim 18, wherein the oxygen bleeding assembly includes the nozzle and an oxidation catalyst.

20. The system of claim 18, wherein the oxygen bleeding assembly includes the nozzle and an ignition source.

21. The system of claim 18, wherein each of the legs further includes at least one sensor configured to sense at least one of NOx, lambda, temperature, or flow rate.

22. The system of claim 18, wherein the sensed temperature is a temperature of the portion.

23. The method of claim 1, further includes controllably cooling a NOx absorber of the desulfation leg after desulfation.

24. The method of claim 23, wherein controllably cooling the NOx absorber includes stopping the injection of reductant into the exhaust flow and restricting the flow rate of the exhaust flow through the desulfation leg.

25. The method of claim 23, wherein controllably cooling the NOx absorber includes controlling a rate at which oxygen is permitted to contact the NOx absorber.

26. The method of claim 23, wherein controllably cooling the NOx absorber includes controlling a rate at which reductant particles remaining on the NOx absorber are burned following desulfation.

27. The method of claim 23, wherein controllably cooling the NOx absorber includes:

substantially prohibiting exhaust flow from passing through the desulfation leg for a predetermined period of time; and ramping up the flow rate of the exhaust flow through the desulfation leg.

28. The method of claim 1, wherein the flow rate of the exhaust flow is modified to cool the desulfation leg to hold the desired desulfation temperature substantially constant.

29. The method of claim 7, wherein the holding of the desired temperature substantially constant during desulfation includes cooling the desulfation leg.

30. The method of claim 7, further including:

sensing at least one characteristic of at least one of an engine and the engine filter system; and determining whether to initiate desulfation based on the at least one sensed characteristic of the at least one of the engine and the engine filter system.

31. The method of claim 7, wherein the holding of the desired temperature substantially constant during desulfation includes modifying an engine-out lambda to assist in holding the desired temperature substantially constant.

32. The system of claim 16, wherein the valving mechanism is configured to modify the flow rate of the portion of the exhaust flow, during desulfation, in response to the sensed temperature, to cool the at least one leg such that the desired desulfation temperature is held substantially constant.

33. The system of claim 16, further including:

a sensor configured to sense at least one characteristic of at least one of an engine connected to the filter system and the filter system; and a controller configured to initiate desulfation based on the at least one sensed characteristic of the at least one of the engine and the filter system.

* * * * *